US005722760A

United States Patent [19]

Chien

[11] Patent Number: 5,722,760

[45] Date of Patent: Mar. 3, 1998

[54] ELECTRO-LUMINESCENT LIGHT ASSEMBLY

[76] Inventor: Tseng Lu Chien, 8F, No. 29, Alley 73, Liu-Slien Street, Shi-Chi Town, Taipei, Hseng, Taiwan

[21] Appl. No.: 783,999

[22] Filed: Jan. 15, 1997

Related U.S. Application Data

[63] Continuation of Ser. No. 383,405, Feb. 3, 1995, abandoned.

[51] Int. Cl.[6] ..... F21L 15/08

[52] U.S. Cl. ..... 362/84; 362/238; 362/226; 362/812; 362/396; 40/552; 40/576; 439/56; 439/554

[58] Field of Search ..... 362/226, 84, 238, 362/239, 240, 249, 285, 288, 367, 396, 812, 237; 40/564, 573, 605, 442, 552, 576, 551, 620; 439/56, 554, 558, 553

[56] References Cited

U.S. PATENT DOCUMENTS

| | | | |
|---|---|---|---|
| 3,404,475 | 10/1968 | Coad | 40/552 |
| 3,447,253 | 6/1969 | Coad | 40/552 |
| 3,553,870 | 1/1971 | Rudolph | 40/576 |
| 3,881,809 | 5/1975 | Fergason et al. | 362/812 |
| 4,028,828 | 6/1977 | Chao et al. | 40/552 |
| 4,177,497 | 12/1979 | McCook et al. | 362/29 |
| 4,318,158 | 3/1982 | Livermore et al. | 362/29 |
| 4,547,840 | 10/1985 | Tinder | 362/226 |
| 4,897,769 | 1/1990 | Lang | 362/226 |
| 5,151,679 | 9/1992 | Dimmick | 362/800 |
| 5,276,598 | 1/1994 | Hedenstrom et al. | 362/238 |
| 5,339,550 | 8/1994 | Hoffman | 362/84 |

*Primary Examiner*—Thomas M. Sember
*Attorney, Agent, or Firm*—Bacon & Thomas

[57] ABSTRACT

A light assembly is made up of a circuit board and a plurality of individual light units which can be installed on and removed from the circuit board to form a desired design or pattern. Each individual light unit includes an electro-luminescent light panel and a resilient contact arrangement which permits an electrical connection between the contacts in the individual light unit and contact terminals on the circuit board to be established by the act of mounting the individual light unit on the circuit board. The light unit itself may form a sub-assembly of a larger lighting arrangement, and each sub-assembly may include a plurality of individual light units arranged into groups, with each group having a different color.

29 Claims, 15 Drawing Sheets

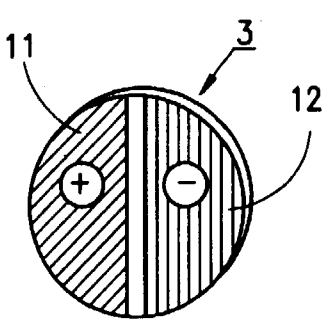
FIG. 3-A
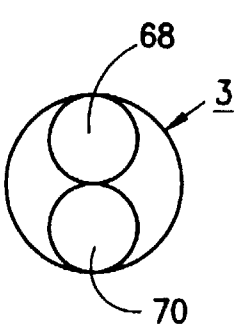
FIG. 5A
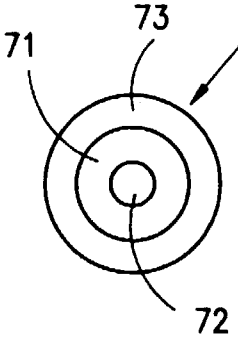
FIG. 5B
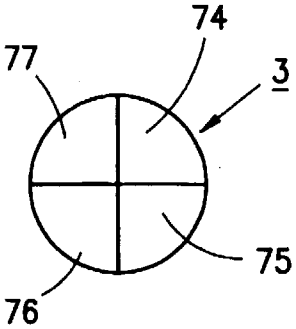
FIG. 5C
FIG. 5A'
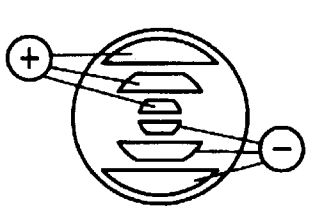
FIG. 5B'
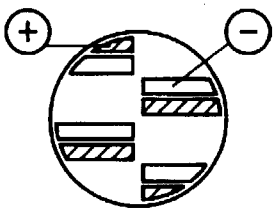
FIG. 5C'
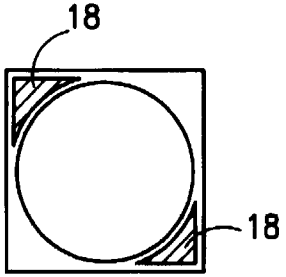
FIG. 4-1
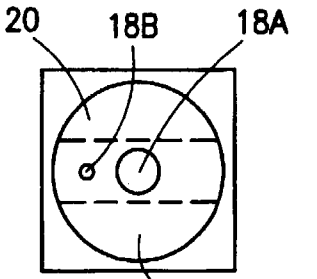
FIG. 4-2
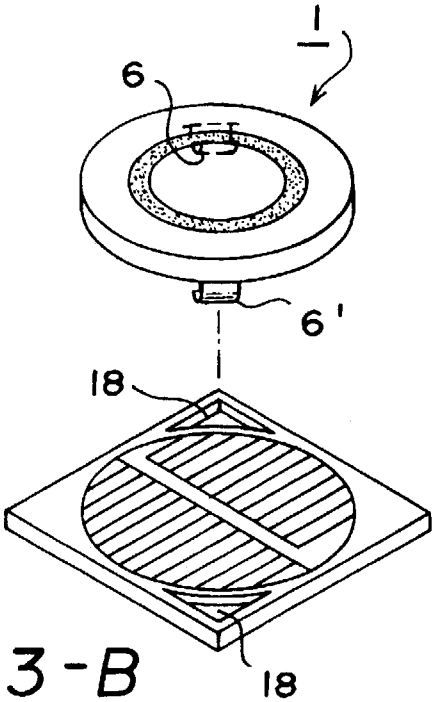
FIG. 3-B

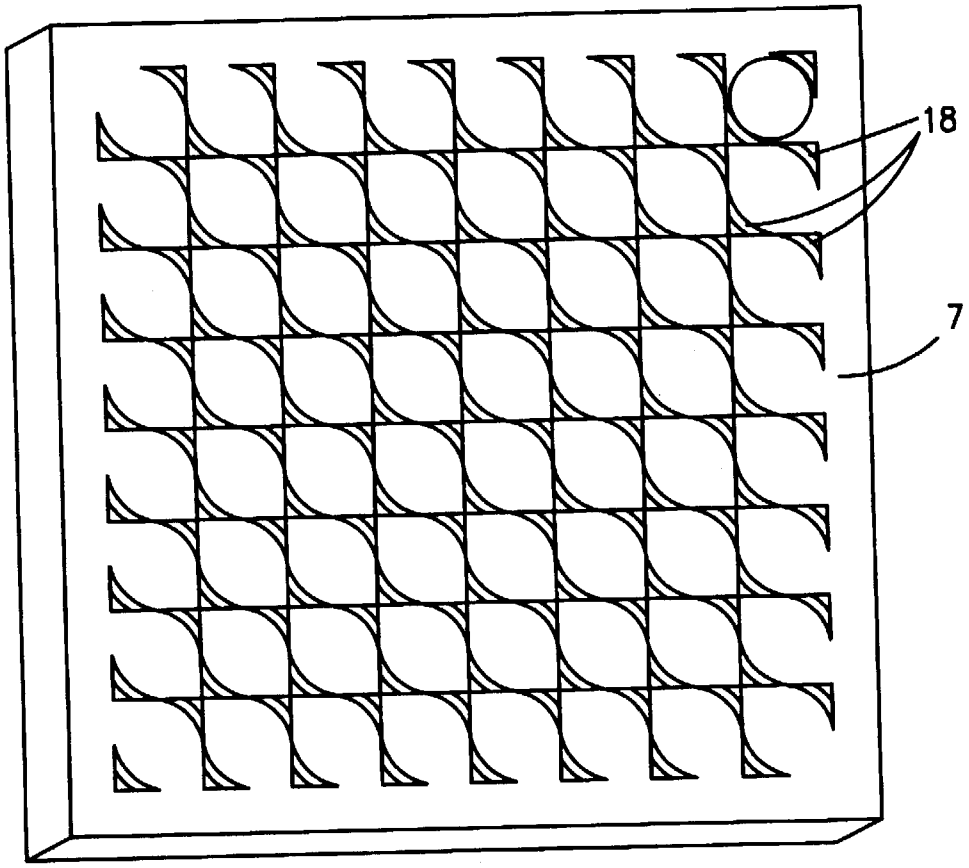
FIG. 4-A-1
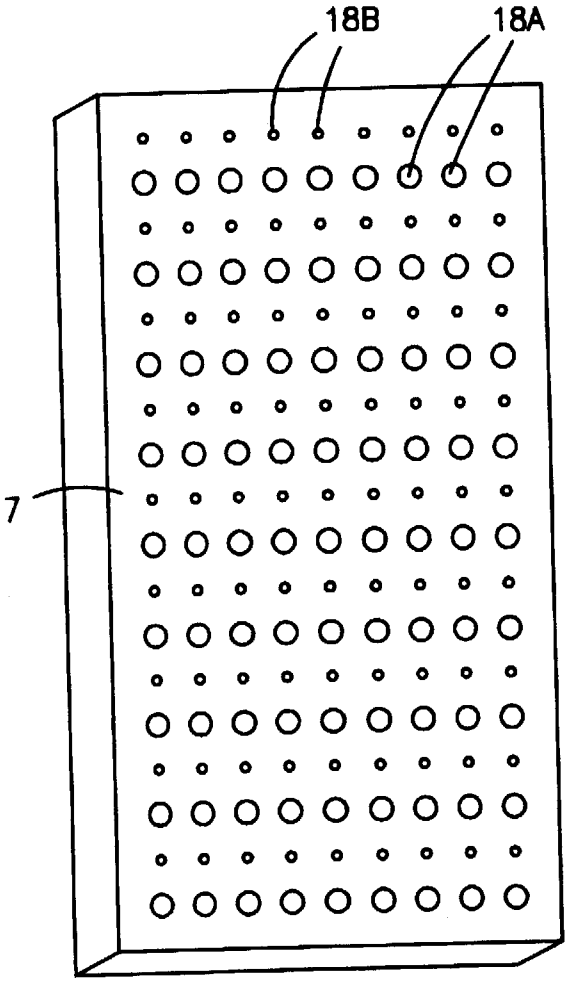
FIG. 4-A-2

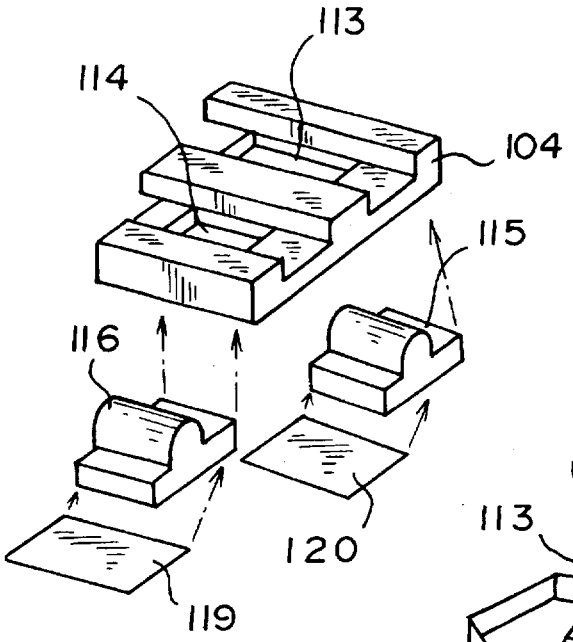
FIG. 11
FIG. 10
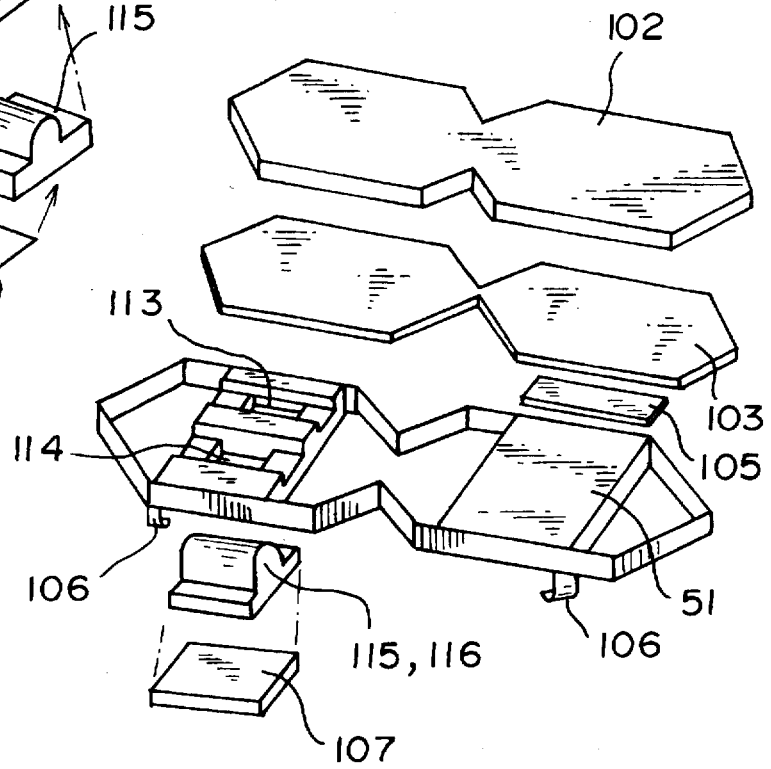
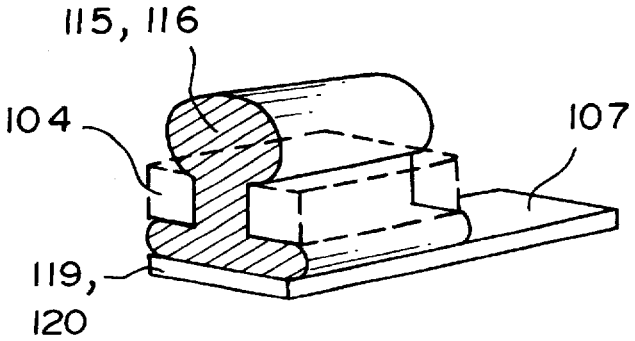
FIG. 12

FIG. 17
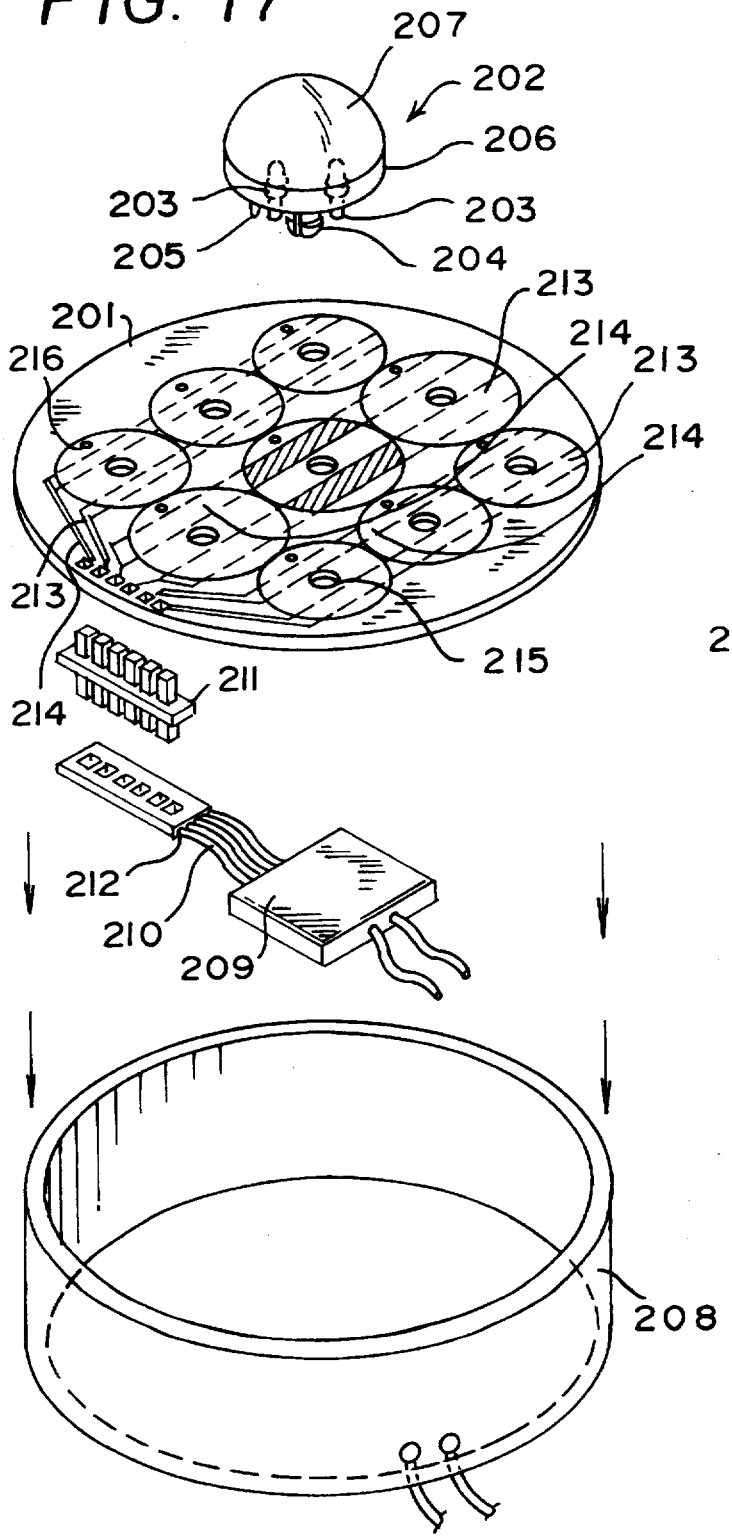
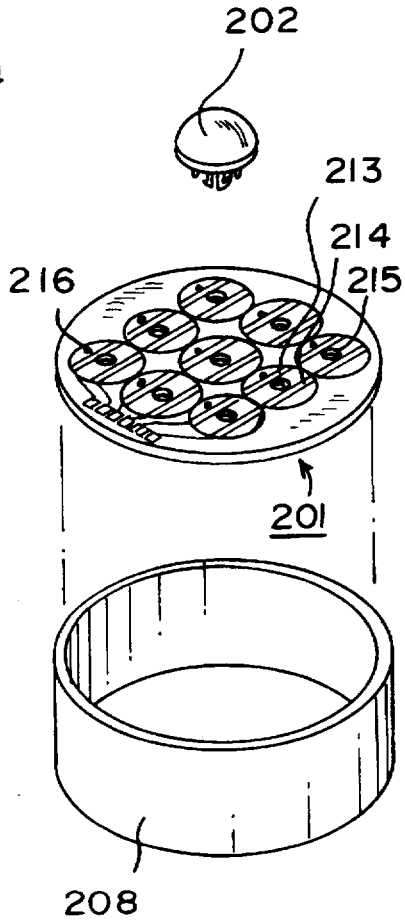
FIG. 16

ELECTRO-LUMINESCENT LIGHT ASSEMBLY

This application is a Continuation of application Ser. No. 08/383,405, now abandoned, filed Feb. 3, 1995.

BACKGROUND OF THE INVENTION

1. Field of the Invention

This invention relates to a self-contained light assembly which includes a control circuit and a plurality of individually removable electro-luminescent (EL) light units which can be arranged to form different messages or designs, and to an individual light unit suitable for use in such a light assembly.

2. Discussion of Related Art

The present invention is directed to light assemblies of the type which are used to form patterns or messages for artistic or informational purposes. Such light assemblies may be used, for example, as house number lights, emergency exit indicators, warning signs for utility location, business identification displays, and advertisements, as well as for informational purposes in general, such as in time/temperature signs, or simply to provide a pleasing lighting effect in both indoor and outdoor applications. Requirements of such light assemblies include adequate brightness, viewing angle, and, particularly in outdoor applications, weather resistance and durability.

It is conventional to construct light assemblies of the type described above of a matrix array of individually controlled light emitting diodes (LEDs) or incandescent lamps, or to use fluorescent tubing arrangements in which the tubes are configured to convey the desired message or to conform to a selected design. While incandescent and fluorescent displays consisting of a light source behind a transparent panel (made, for example, of acrylic) have the best viewing angle, power consumption is especially high in relation to brightness, and the bulbs or tubes are vulnerable to vibrations, drops, and other impacts, as well as vulnerability to inclement weather conditions, including wind. LED displays, on the other hand, have greater brightness and durability, but the maximum viewing angle for a conventional LED is approximately 45 degrees from center, and LEDs with sufficient brightness for most applications are limited to only three colors: red, green, and amber, which is not a sufficient color range for many applications.

In addition to problems of fragility, power consumption, and lack of brightness in conventional fluorescent or incandescent displays, and problems of limited viewing angle and color choice in conventional LED displays, the traditional lighting designs share the disadvantage that configuration of a particular display is generally fixed due to the difficulty in handling individual LEDs or incandescent lamps, and the need to provide a rigid structure for the matrix as a whole in order to protect the lighting elements. Such displays are, for example, in general limited to a planar surface, or at least to a fixed shape. In addition, the conventional light assemblies, including LED displays, are relatively bulky and high in cost. While programming can allow the message in a single configuration to be changed by the user, the configuration itself generally cannot be changed, and thus the conventional displays require a larger number of lighting units than is required for any individual message or design, with only a portion of the lighting units in use at a given time.

SUMMARY OF THE INVENTION

It is accordingly an objective of the invention to overcome the limitations of conventional light assemblies by providing a light assembly which is flexible, multi-colored, has a wide viewing angle, uses little power, and yet can easily be modified by the user without the need for complex hardware or programming by removing or replacing individual light units as necessary so that only those light units necessary to form the desired message or design need be included in the panel.

By provided for user modification of the display in a way which minimizes the number of light units used, and also by providing light units themselves which are simple to assemble, the invention seeks to greatly lower the costs of such displays to the user, and increase the number of applications in which they can be economically utilized. Further, by providing individual light units which are based on EL segments, the invention provides a light assembly having advantages of weight, power consumption, brightness, and viewing angle which can only be provided by EL lighting technology. Finally, by providing a light panel with easily replaceable lighting elements based on EL lighting technology, and which furthermore is self-contained and can easily be connected as a unit to any common power source, the invention achieves a general versatility unmatched by any conventional lighting arrangement, including LED displays, fluorescent and incandescent lighting, and neon tube assemblies.

These objectives and advantages of the invention are accomplished firstly by providing a unique panel arrangement which permits simplified mounting of the individual light units to the panel and at the same time provides all necessary electrical connections and control circuitry. Secondly, the objectives and advantages of the invention are achieved by providing, in connection with the simplified panel mounting arrangement, individual removable light units which are themselves unique in design, both to facilitate mounting and removal from the panel and to provide optimal utilization of the EL segments contained therein. Cost savings are achieved by using only as much of the EL material as necessary, and by reducing the complexity and number of assembly steps in comparison to a conventional light assembly, including the use of low cost injection molding tooling for all non-standard components of the display.

In a first preferred embodiment of the invention, the panel on which the individual light units are mounted is arranged to permit the individual light units to be installed simply by inserting them into holes in a printed circuit board, the EL units being retained by a retention assembly made up of diametrically opposed "hooks" which securely retain the individual EL units on the circuit board while permitting easy disengagement. Furthermore, in this embodiment, electrical connection is established, without additional steps such as soldering, or additional hardware, by the same step of inserting the hooks into holes in the board which is used to mount the EL units, the electrical connection being provided by a unique contact structure based on conductive rubber elements arranged to have a self-biasing effect which ensures a maximum contact area when the EL units are installed on the circuit board by means of the above-mentioned hooks.

In a variation of the first preferred embodiment of the invention, which utilizes the same principles of removability and of establishing the necessary electrical connections by means of self biasing contacts upon mounting of the individual EL unit to a panel, the diametrically opposed hooks are replaced by a centrally located hook assembly and positioning post.

In further variations of the preferred embodiment of the invention, the shape of the individual light units is varied from a cylindrical shape to a polyhedral shape which is especially suitable for forming numbers with a minimum of different individual units, and the control circuit is varied to permit different light performances, including steady state, flashing, random, chasing, and fade-in/fade-out effects.

In each of the preferred embodiments of the invention, construction of the individual EL units can be accomplished in essentially three simple assembly steps, namely placement of the conductive rubber contacts into openings provided in an EL unit housing, positioning of an EL segment relative to the contacts, and fixing of a cover onto the housing.

Because of this simple, low cost construction, it is not necessary to provide a complex computer control system and an array of lighting units only some of which are in use at any given time in order to vary the display. Instead, the user who wishes to change the display can do so simply by removing or installing individual EL units from or to appropriate openings in a printed circuit board to vary the display while using only as many EL units as necessary. This is especially suitable for a small business owner who may only need to change the displayed message (e.g., shop name, shop type, product item, and so forth) a few times, if at all, during the useful life of the display. Initially, the business owner or other end-user of the display can purchase the exact number of display elements needed for the message in question, and then later if a need arises to change the message in a way which requires additional elements, can easily obtain the additional elements and change the display without any technical assistance.

Finally, in yet another preferred embodiment of the invention, the lighting assemblies of the above-described preferred embodiments may be modified to form sub-assemblies of a larger master assembly and thereby provide even greater versatility for certain applications, and in particular as a substitute for the conventional "so-called "L.O.D." arrangement of LEDs, the use of EL sub-assemblies providing a greater variety of color effects, an increased viewing angle, better picture resolution (fine details), lower cost and greater durability. For example, if each subassembly includes 13 different color units, each having a total of 20 different possible colors, then each sub-assembly can have 20×13=260 colors. A master EL light assembly could have as many as 200 such sub-assemblies, each with a 260 color pixel resolution.

BRIEF DESCRIPTION OF THE DRAWINGS

FIG. 3-1 is an exploded perspective view of an individual removable EL light unit for use in connection with the panel arrangement of FIG. 1.

FIG. 3-2 is an exploded perspective view of a variation of the individual removable EL light unit shown in FIG. 3-1.

FIG. 3A is a perspective view of an EL segment for use in the individual removable EL light units of either FIG. 3-1 or FIG. 3-2.

FIG. 3B is a perspective view illustrating in detail the manner in which the EL unit of FIG. 3-1 is attached to the panel mounting arrangement of FIG. 1, and also a variation of the electrode configuration of the EL panel shown in FIG. 3-A.

FIGS. 4-1 and 4-2 are plan views showing the mounting configurations of the preferred panel mounting arrangement and variation thereof shown in FIG. 1.

FIGS. 4-A-1 and 4-A-2 are bottom views of the respective EL units shown in FIGS. 3-1 and 3-2.

FIGS. 5A, 5A', 5B, 5B', 5C, and 5C' are plan views of various electrode designs for the EL unit of FIGS. 3-1 and 3-2.

FIG. 10 is an exploded perspective view of a removable individual EL unit for use in the EL unit assembly of FIG. 8.

FIG. 11 is a perspective view illustrating the manner in which EL contacts for the EL unit of FIG. 10 are mounted.

FIG. 12 is another perspective view of the EL contact arrangement shown in FIG. 11.

FIGS. 16 and 17 are perspective views showing details of the sub-assemblies of FIG. 15.

DETAILED DESCRIPTION OF THE PREFERRED EMBODIMENTS

FIGS. 1–6 depict a light assembly made up of individual EL units 1 constructed in accordance with the principles of a first preferred embodiment of the invention. In this embodiment, the EL units are generally cylindrical in shape, although those skilled in the art will appreciate that the construction of the individual EL units permits the shape to be varied in any desired manner, including that described in connection with the second preferred embodiment of the invention, illustrated in FIGS. 7–14.

Figure 1:
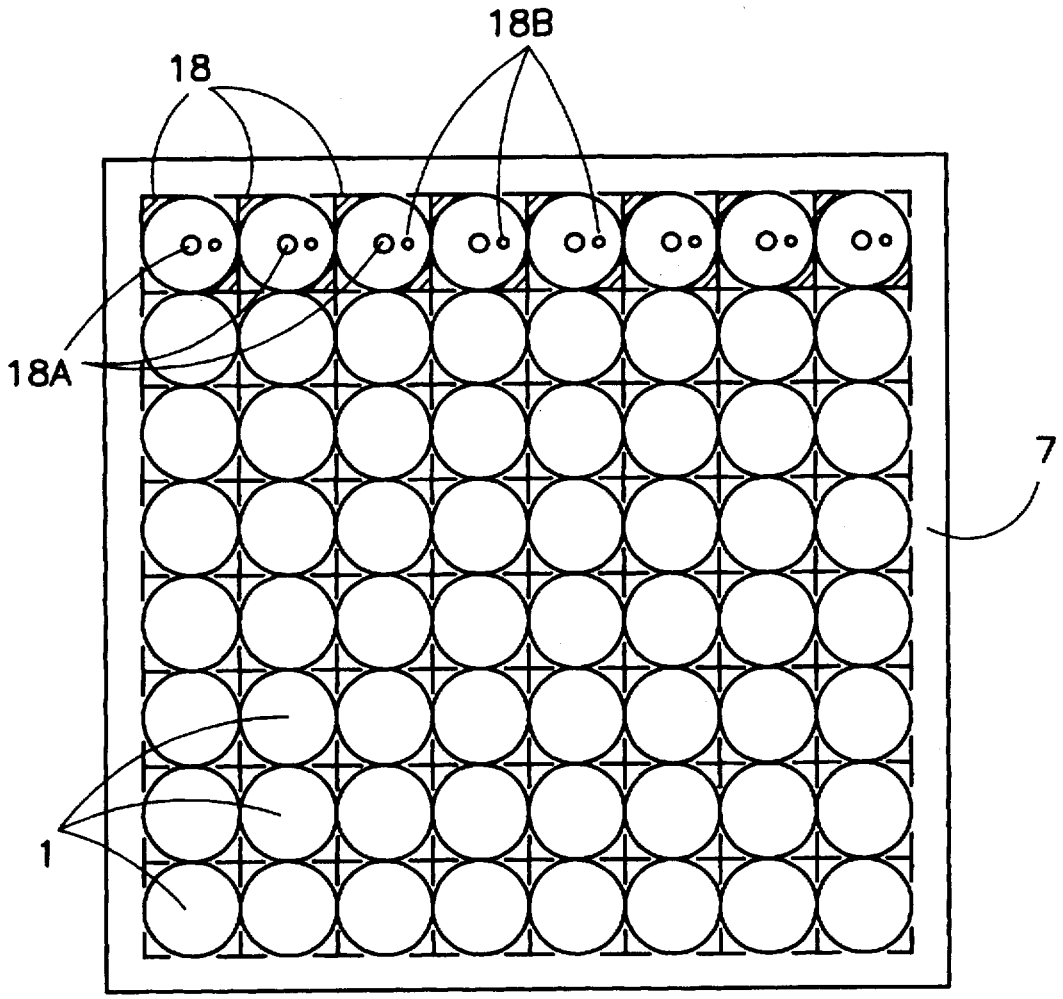
FIG. 1 is a plan view of a panel mounting arrangement for a light assembly which simultaneous illustrates the mounting configurations of a preferred embodiment of the invention and a variation thereof.
Figure 2:
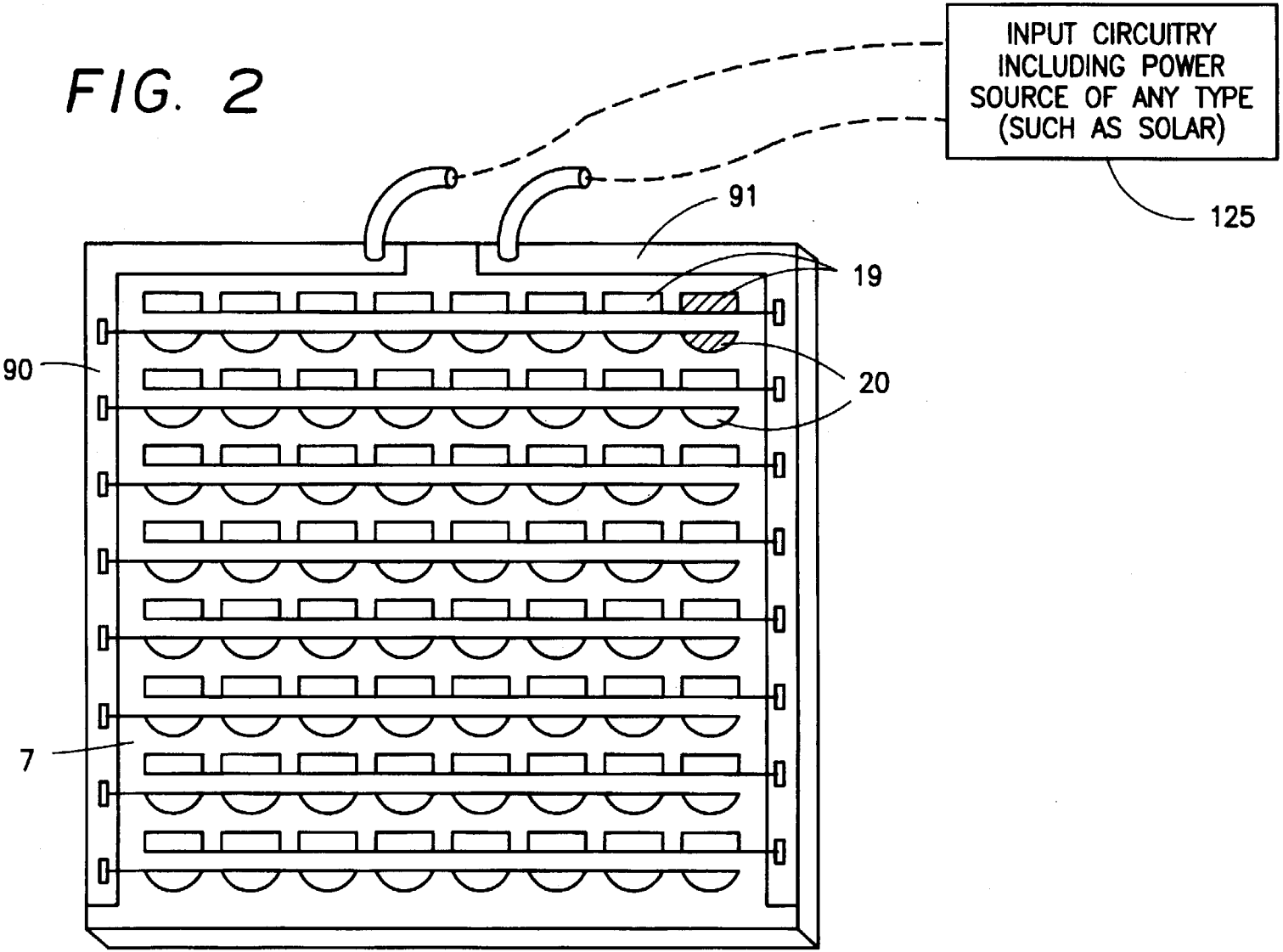
FIG. 2 is plan view of the wiring design for the panel arrangement shown in FIG. 1.
Figures 2, 3:
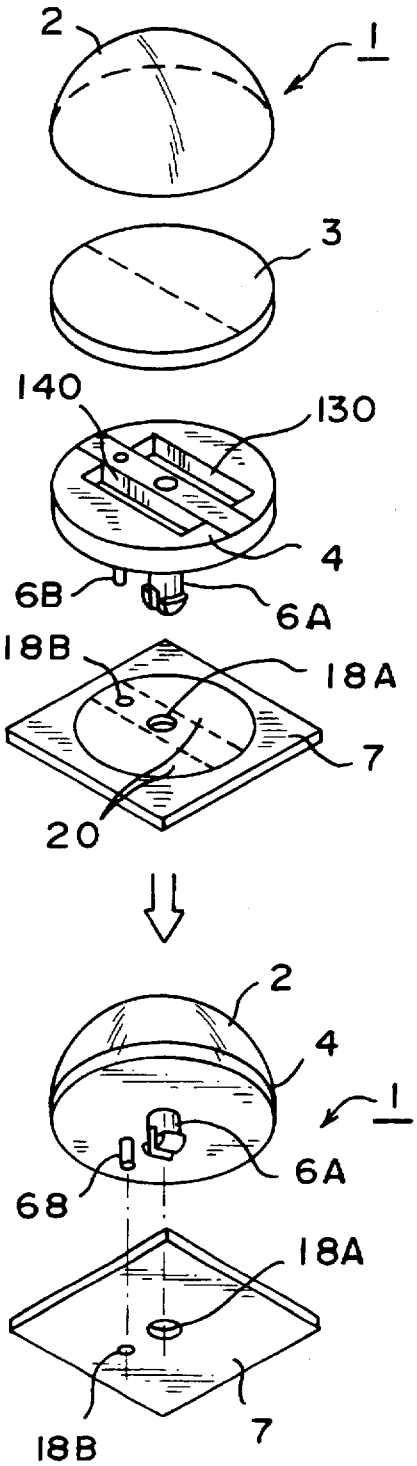
Figures 1, 3:
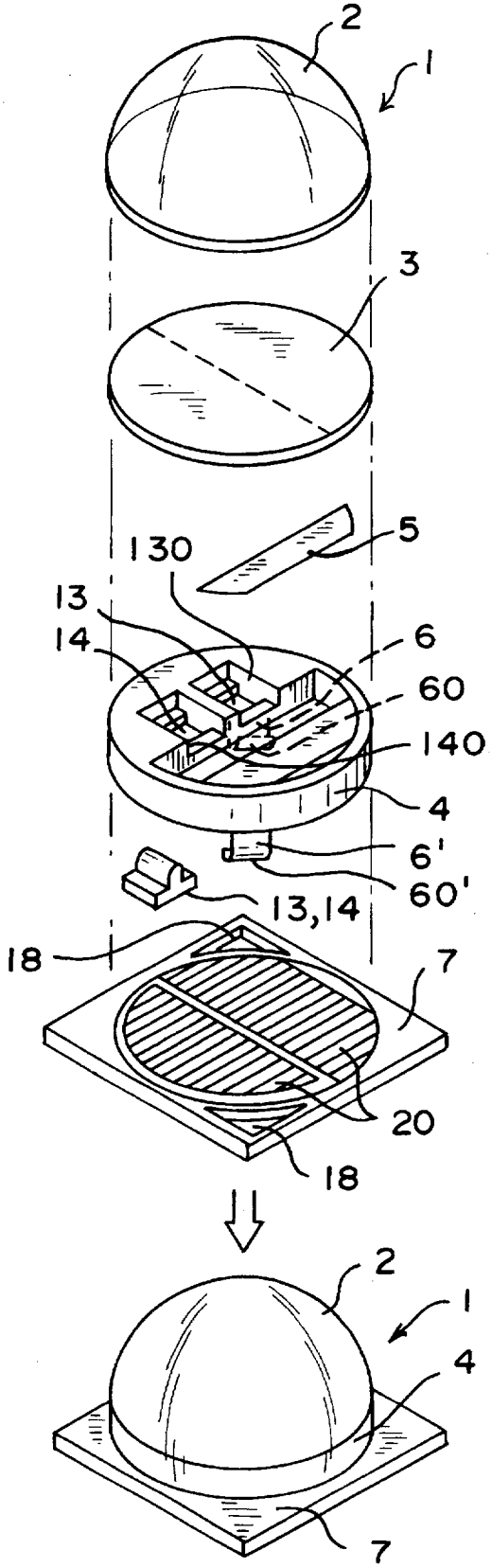

The principal elements of the preferred light assembly are a printed circuit board 7 which also serves as a mounting panel, as illustrated in FIGS. 1, 2, 4-1, and 4-2, and individual EL units 1 illustrated in FIGS. 3-1 and 3-2. Mounting is provided by the openings 18, 18A, and 18B, which are arranged to receive a pair of mounting members in the form of hooks or hook assemblies and positioning posts as will be described below.

The circuit board is, as is conventional, made up of a substrate on which is "printed" a circuit pattern, using a deposited conductive material, conductive foil, or any other arrangement for forming traces which carry electric power to components, in this case the individual EL units, mounted on the substrate. The traces are divided into two groups, one of which extends via a low voltage bus from a low voltage input 90 to contacts 20, illustrated in FIG. 2 as being semi-circular in shape, and the other of which extends via a high voltage bus from high voltage input 91 to contacts 19, illustrated as being rectangular in shape. There is of course no inherent reason why the contacts need to have the particular shapes shown in the drawings, and both the contact and trace configuration may be varied as desired. The use of an array, however, is preferred because it gives the greatest flexibility when arranging individual EL units on the board to create a desired design or message.

The input circuitry 125 is illustrated in schematic form in FIG. 2. Those skilled in the art will appreciate that the necessary EL trigger circuitry can easily be implemented using low cost components, including a power source of any type (such as solar), a DC/AC converter and transformer (if necessary) to convert the supplied power to the necessary voltage and frequency, and a switch if desired. Because the message is formed by the actual physical layout of the individual EL units, i.e., by their location on the circuit board rather than by selectively turning individual units on and off, only two input wires are necessary, and thus great flexibility in the location and arrangement of the control circuitry is possible. While sophisticated microprocessor controlled switching arrangements are not necessary, however, it is easily possible to achieve special effects by means of inexpensive conventional circuit controllers which modulate the input signal to achieve special effects such as flashing, random on/off patterns, chasing effects (similar to Christmas tree lights), and fade-in/fade-out effects.

An individual removable EL unit 1 for use in this preferred embodiment of the invention is shown in FIG. 3-1. The individual EL unit includes a light transmitting cover 2, an EL panel 3, a housing 4, contacts 13 and 14, and mounting legs 6 and 6' for retaining the EL unit on the circuit board.

In this embodiment, the EL unit is mounted to the circuit board by inserting legs 6 and 6', which may be integrally molded or discrete elements made of plastic metal or any other suitable material, as those skilled in the art will appreciate, and which include extensions 60 and 60' to form hooks, through respective diametrically opposed openings 18 in the circuit board such that the legs flex outwardly as they pass through the openings and then are hooked by extensions 60 and 60' as the extensions pass through the opening and engage an opposite side of the board from the side on which the EL unit is mounted. To this end, the hooks formed by legs 6 and 6' with extensions 60 and 60' preferably include a taper or upward slope which facilitates insertion into the openings in the circuit board, with the length or the legs corresponding generally to the thickness of the circuit board so as to ensure that the individual EL unit is pressed tightly against the board after assembly.

An advantage of this retention leg design is that, in addition to facilitating mounting of the individual EL units to the circuit board, the EL units are also easily removable by reversing the assembly sequence, i.e., by simply flexing the legs outwardly until the hooks disengage from the back side of the circuit board, and then removing the individual EL unit from the panel, thereby pulling the legs through openings 18.

In the variation of the preferred embodiment shown in FIG. 3-2, diametrically opposed legs 6 and 6' are replaced by centrally located hook assemblies 6A and positioning posts 6B, with corresponding changes in the position of slots 13 and 14 to retain the individual light unit on the printed circuit board 7. Hook assemblies 6A each includes a pair of hooks 60A which are shape to flex in response to insertion into openings 18A and then catch the opposite side of the circuit board as a result of the restoring force of the hook assembly material to retain the individual light unit on the circuit board. As with the variation shown in FIG. 3-1, removal of the light unit can be accomplished simply by manually flexing the hooks by an amount sufficient to clear a respective opening 18A. Positioning post 6B are included solely for the purpose of preventing rotation of the light unit after assembly to the circuit board, which could otherwise result in misalignment of the contacts and a consequent short-circuit, but do not serve in this embodiment to retain the light unit on the circuit board, and thus openings 18B need not extend all of the way through the circuit board.

FIGS. 4-1, 4A-1, 3B-1, 4-2, 4A-2, and 3B-2 respectively show details of the arrangement of openings 18, 18A, and 18B on circuit board 7 for the two illustrated variations of the first preferred embodiment of the invention, and in particular the manner in which they are arranged in a matrix of rows and columns to permit display of a wide variety of different designs and messages depending on the positions of the individual light units in the matrix. The point of this configuration is to allow the cylindrically-shaped individual lights units to be positioned anywhere in the matrix, with all openings not used in the message or design left open, thereby minimizing the number of light units actually required to form the desired message or design, in contrast to the prior art arrays in which an LED or other lighting element is present at all matrix positions and the pattern is formed by selectively switching on individual light elements using a computer controlled switching circuit. Although openings 18 are depicted as being diagonally positioned relative to the rows and columns of the matrix formed thereby, and openings 18A and 18B are depicted as being arranged in parallel columns, those skilled in the art will appreciate that the openings could also be arranged in side-by-side fashion, or in any other configuration so long as the openings are spaced a distance apart which corresponds to the separation of the legs on the EL units and permits passage of the circuit board trace to each of the units while leaving sufficient space for the electrical contacts.

At the same time that the EL unit is mounted on the circuit board in the manner described above, an electrical connection to terminals or contacts on the circuit board is also established by means of contacts 13 and 14, as follows: The EL unit itself is made up of a housing 4, which is in this embodiment generally cylindrical in shape, having slots 130 and 140 extending therethrough from a top surface to the base which is mounted on the circuit board, the top surface providing a generally flat area on which to accommodate an EL panel or segment 3. As is best shown in FIGS. 11 and 12, in connection with the second preferred embodiment of the invention (the contacts are the same for both embodiments), the contacts are shaped to fit through slots 113 and 114 which, in the first preferred embodiment, could be molded integrally into housing 4, although those skilled in the art will appreciate that a separate contact-supporting member could also be provided. The slots preferably have a width which is narrower than the unconstrained width of the contacts, which are made of a flexible conductive material such as conductive rubber, thus causing the contacts to be retained by the slots after insertion therethrough in the manner shown in FIG. 12, without the need for additional retention means such as an adhesive or mechanical retention arrangement. The total height of the contacts exceeds the distance between the base of the EL unit and the lower surface of the EL panel 4, as shown in FIG. 3, such that when the EL unit is mounted on the circuit board, the contact is compressed between the EL panel 4 and the respective contact terminals 19 or 20 on the circuit board, the restoring force of the contact material biasing the EL unit contact against the respective electrodes 11 and 12 of the EL panel, illustrated in FIG. 3A, and the respective circuit board contact 19 or 20 to establish a stable low impedance electrical connection therebetween and eliminate the need for soldering or other conventional electrical connection means.

After assembling the contact to the housing by inserting it through the appropriate slots, as described above, the only remaining steps required to complete assembly of an individual EL unit are the steps of securing the EL panel to the housing, thereby compressing the upper portion of the contacts against the corresponding electrodes on the EL panel, and securing a cover on the unit. In the preferred embodiment, the EL panel is held in place during assembly by double-sided adhesive tape, and then secured in place by affixing a top cover 2 to the housing, as shown in FIGS. 3-1 and 3-1, although those skilled in the art will appreciate that a variety of other means for securing the panel to the housing could be substituted for the illustrated means involving adhesive tape and the top cover.

In the preferred embodiment, top cover 2 is affixed to the housing by ultrasonic welding, although other appropriate securing means, including adhesives, may be substituted depending on the material used for the cover. The use of a separate cover has the advantage of allowing the cover to be varied depending on optical requirements of an individual EL unit. For example, the cover may be in the form of a convex lens 2, but also may take a variety of other forms including diffraction gratings and the like for special effects.

FIGS. 5A, 5B, and 5C show various alternate configurations for the EL segment or panel 3 and for the electrodes used in the individual EL units. In the configuration shown in FIG. 5A, the EL segment contains two separate EL elements 68 and 70, which may be of the same or different colors. A possible configuration for the corresponding circuit board contacts or terminals 19 and 20 is shown in FIG. 5A', while FIG. 5B shows a three element configuration in which the EL elements 71–73 are concentrically arranged, FIG. 5B' shows a contact arrangement for this configuration, and FIGS. 5C and 5C' respectively show a four element panel made up of discrete EL elements 74–77 and a corresponding contact arrangement therefor. Those skilled in the art will recognize, of course, that the different EL segment and contact arrangements shown in these Figures is in no way exclusive, and that numerous other arrangements of different numbers of individual EL elements to form an EL panel, including elements of different shapes and colors, may be arranged to form the El panel 3 which ends up being mounted in the individual EL unit 1. In all of these configurations, the basic principles which allow the individual EL units to be mounted and removed from the circuit board without special tools are maintained, however, as evidenced by FIG. 3B, which shows an EL unit in which the E1 element is in concentric form and which uses exactly the same mounting arrangement as shown in FIG. 3-1.

Figure 6:
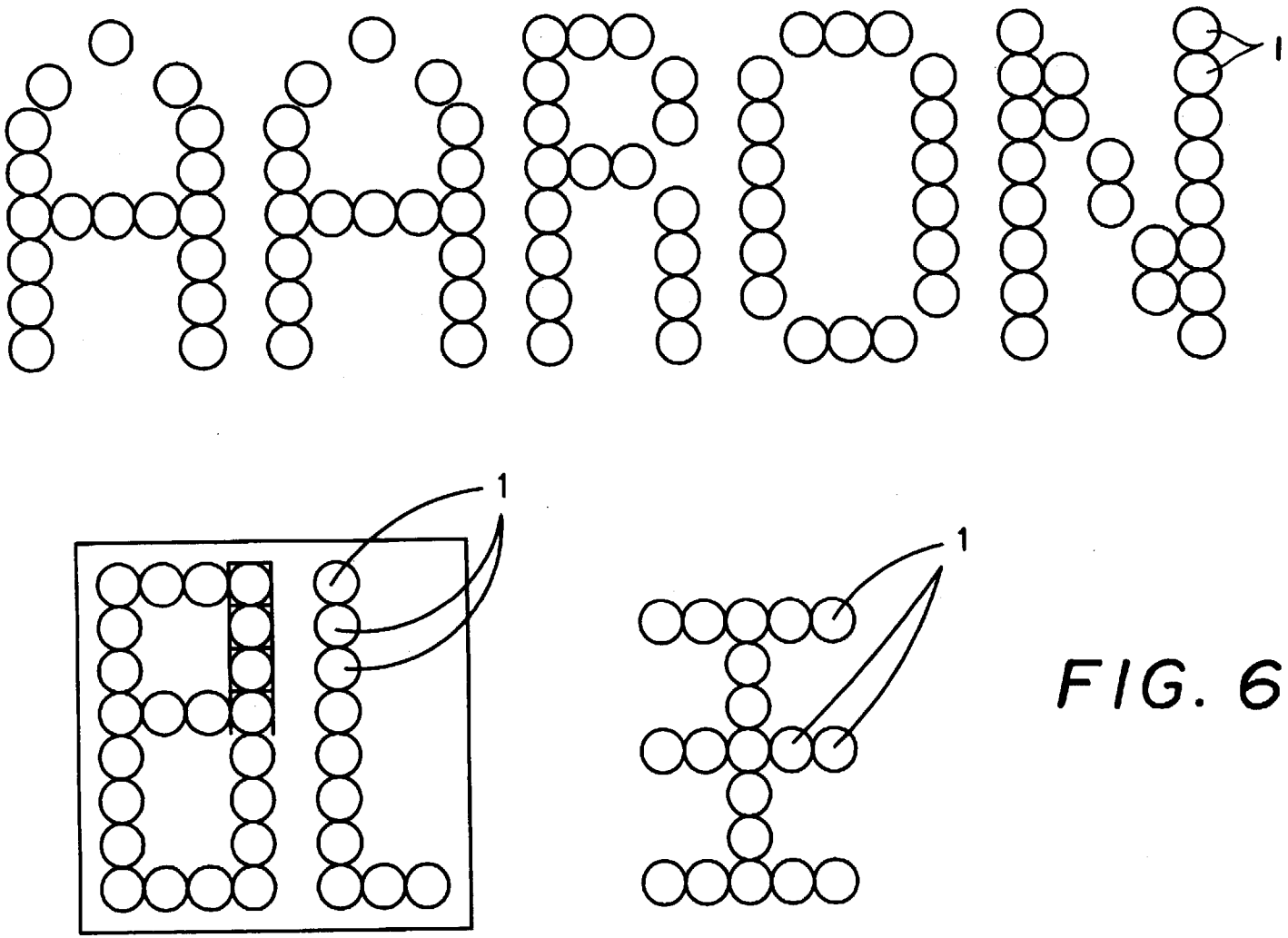
FIG. 6 shows various arrangements of the cylindrical EL unit of FIGS. 3-1 to 5C' according to the first preferred embodiment of the invention.
Figure 7:
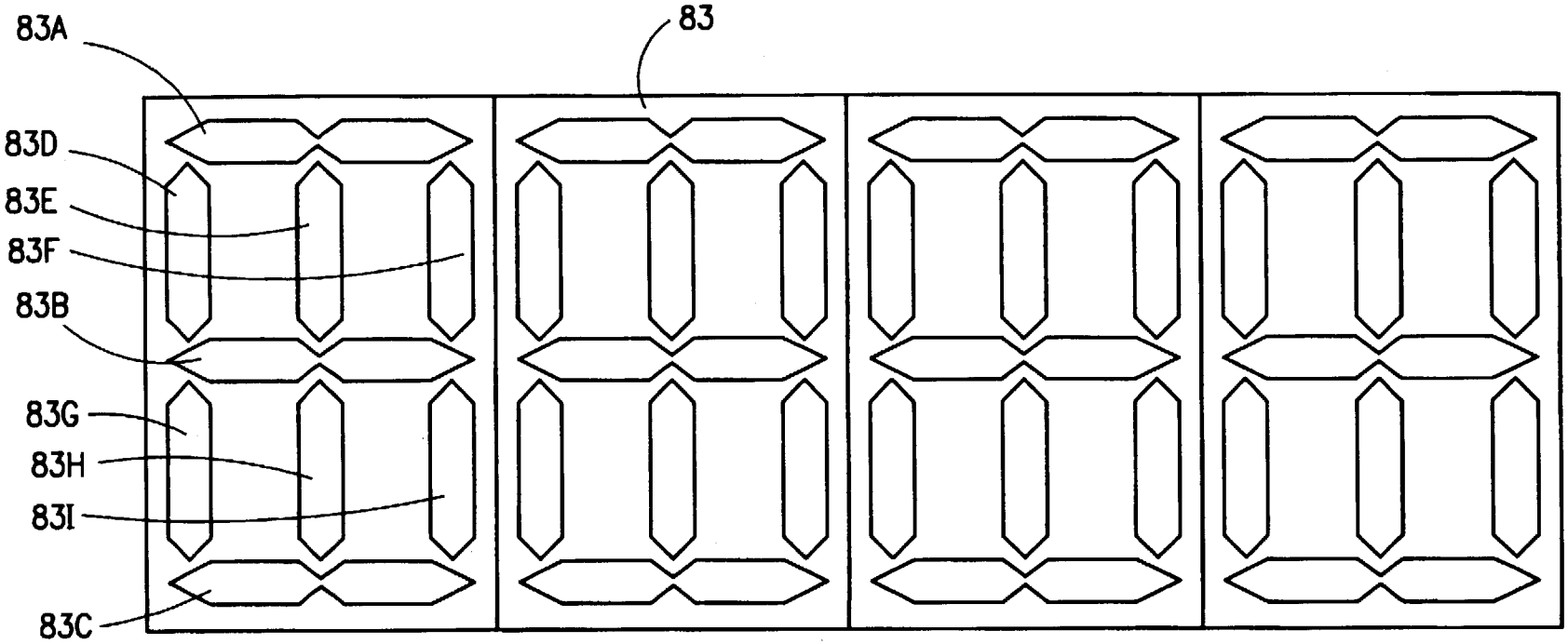
FIG. 7 is a plan view of a cover sheet for use in the panel arrangement of a second preferred embodiment of the invention.
Figure 8:
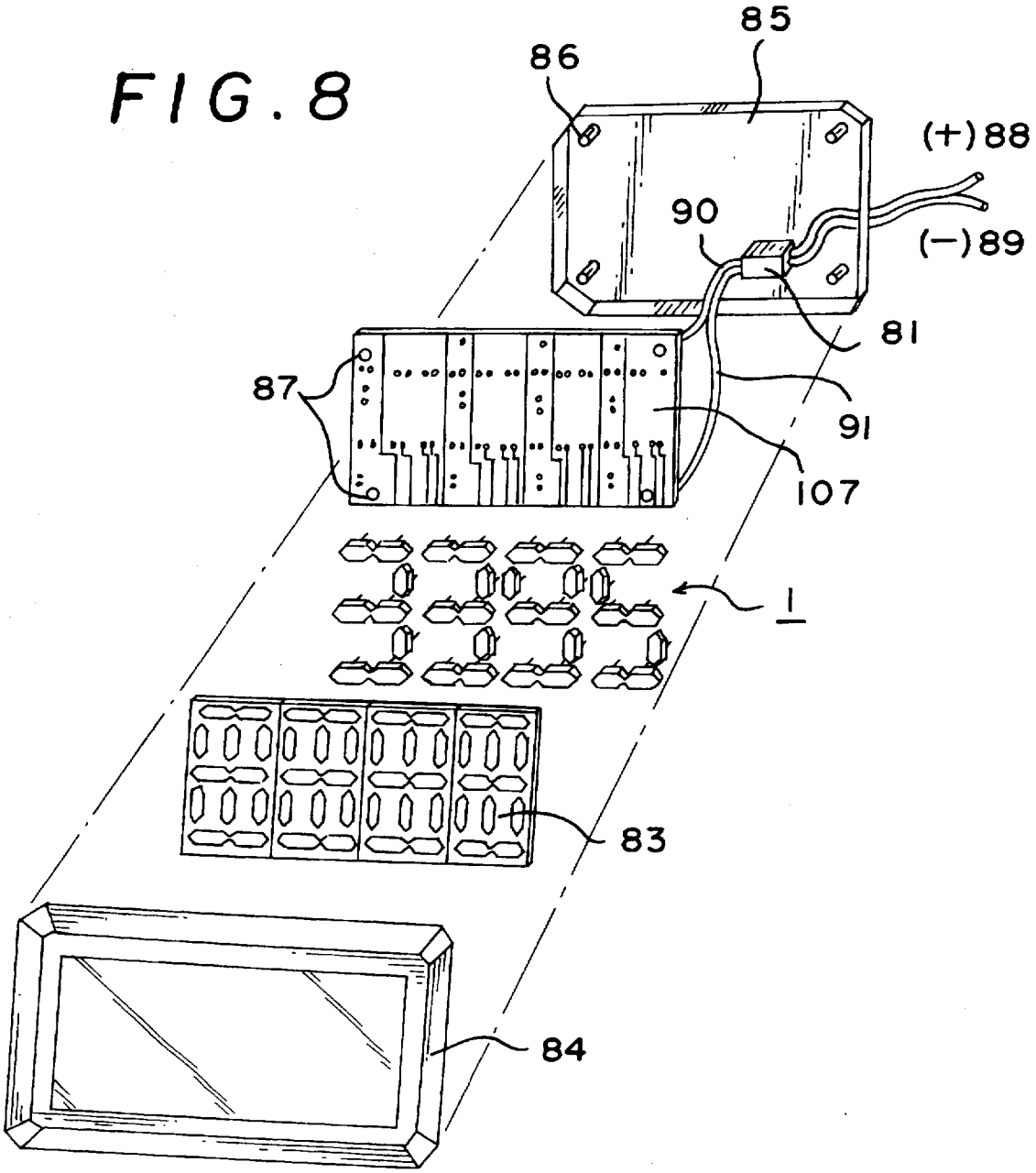
FIG. 8 is an exploded perspective view of the light assembly of the second preferred embodiment of the invention.
Figure 9:
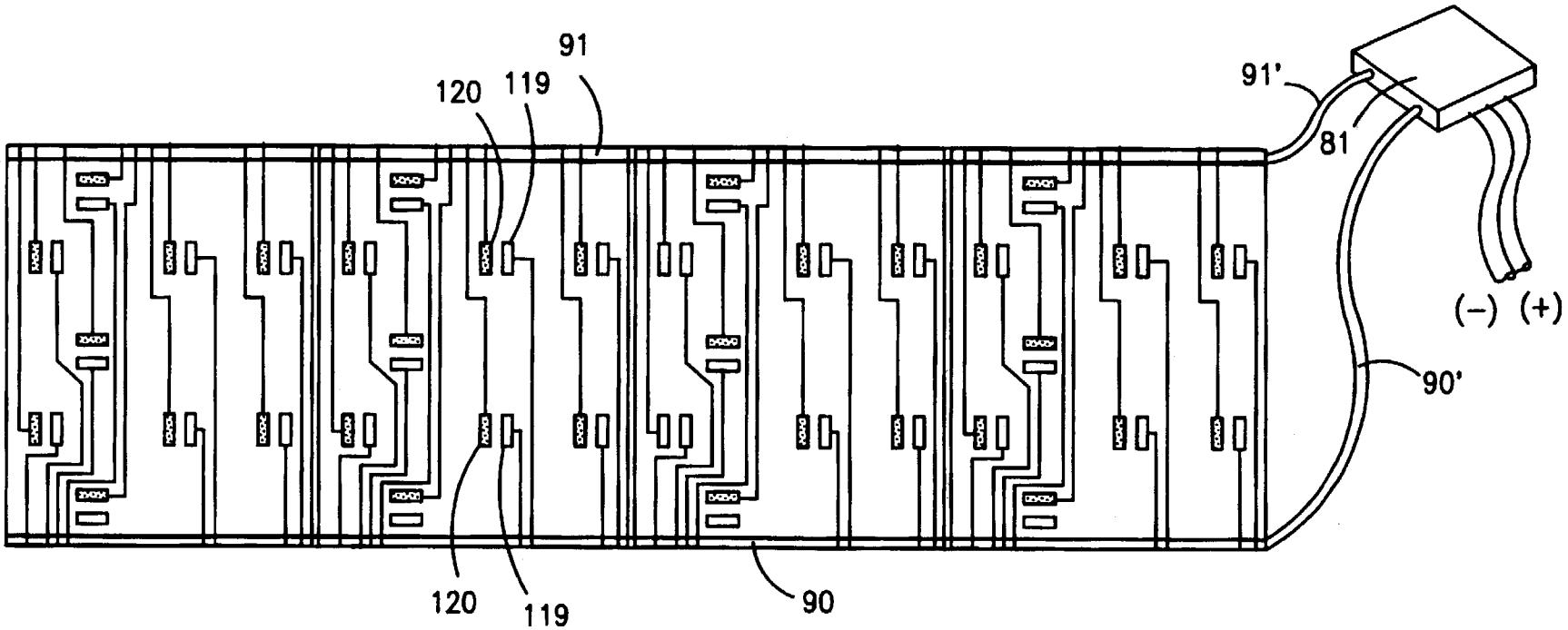
FIG. 9 is a plan view of a wiring arrangement for the EL unit of FIG. 8.

As described above, the first preferred embodiment of the invention thus provides a cylindrically shaped EL light unit which can be arranged anywhere in a matrix of positions defined on a circuit board by mounting openings 18, 18A, and 18B, and contact terminals 19 and 20. Examples of messages which can be formed by appropriate placement of the individual light units are shown in FIG. 6.

In a second preferred embodiment of the invention illustrated in FIGS. 7–14, the EL assembly includes a casing made up of back and front case halves 84 and 85, respectively, an opaque sheet 83 having die cut openings 83A to 83I for individual EL elements, and a circuit board 87 similar to circuit board 7 of the first preferred embodiment of the invention.

The die cut openings in sheet 83 are arranged to accommodate three horizontal segments 83A–83C and six vertical segments 83D–83I in four groups, the segments in each group forming a numeral "8" with an additional two vertical segments bisecting the "8". This configuration allows formation of numbers "0" to "9" with a minimum of wasted material, and an optimal circuit board arrangement, with all low voltage contact terminals 119 being connected by substantially straight traces to low voltage bus line 90 and all high voltage contact terminals 120 being also connected by substantially straight traces to high voltage bus line 91 which are in turn connected by wires to a control circuit housing 81.

Back case half 85 is solid in construction but may include openings 86 for mounting screws and for wiring to an external power source, which may be in the form of a DC power pack, or an AC outlet and AC/DC converter. The circuit components for controlling energization of the individual units are provided in a housing 81 and may include a variety of known components, including flasher circuits and the like for special effects, or even a microprocessor controller, as those skilled in the art will appreciate.

In the illustrated embodiment, the printed circuit board is mounted to the back case via screw holes 86 and 87, and the high and low voltage buses 90 and 91 are electrically connected to the control circuit by means of + and − input wires 90' and 91'. The EL units, shown in greater detail in FIGS. 10–13 have a generally polyhedral shape. Front case half 84 consists of a frame which defines a window into which may be fitted the above-described cover sheet 83 having pre-cut openings corresponding in shape to that of the EL units, but which provides for different EL unit configuration.

Each individual EL unit includes a top cover 102, an EL panel 103 cut to a shape corresponding to that of the top cover, and a housing 104 having slots 113 and 114 for accommodating the rubber contacts 115 and 116 which engage terminal 19 and 20 on the circuit board. The height of the contacts is such that when the EL unit is mounted on the circuit board, and EL panel 103 is affixed to the housing, for example by double-sided tape, the contacts will exert pressure on both the circuit board terminals and the EL panel to ensure good electrical contact, the contacts being made of a resilient conductive material such as conductive rubber. As illustrated, the contacts have a square base sized to provide a maximum contact area with the circuit board contacts, and a narrowed section shaped to fit through the openings in the housing and thereby contact the EL panel.

Figure 13:
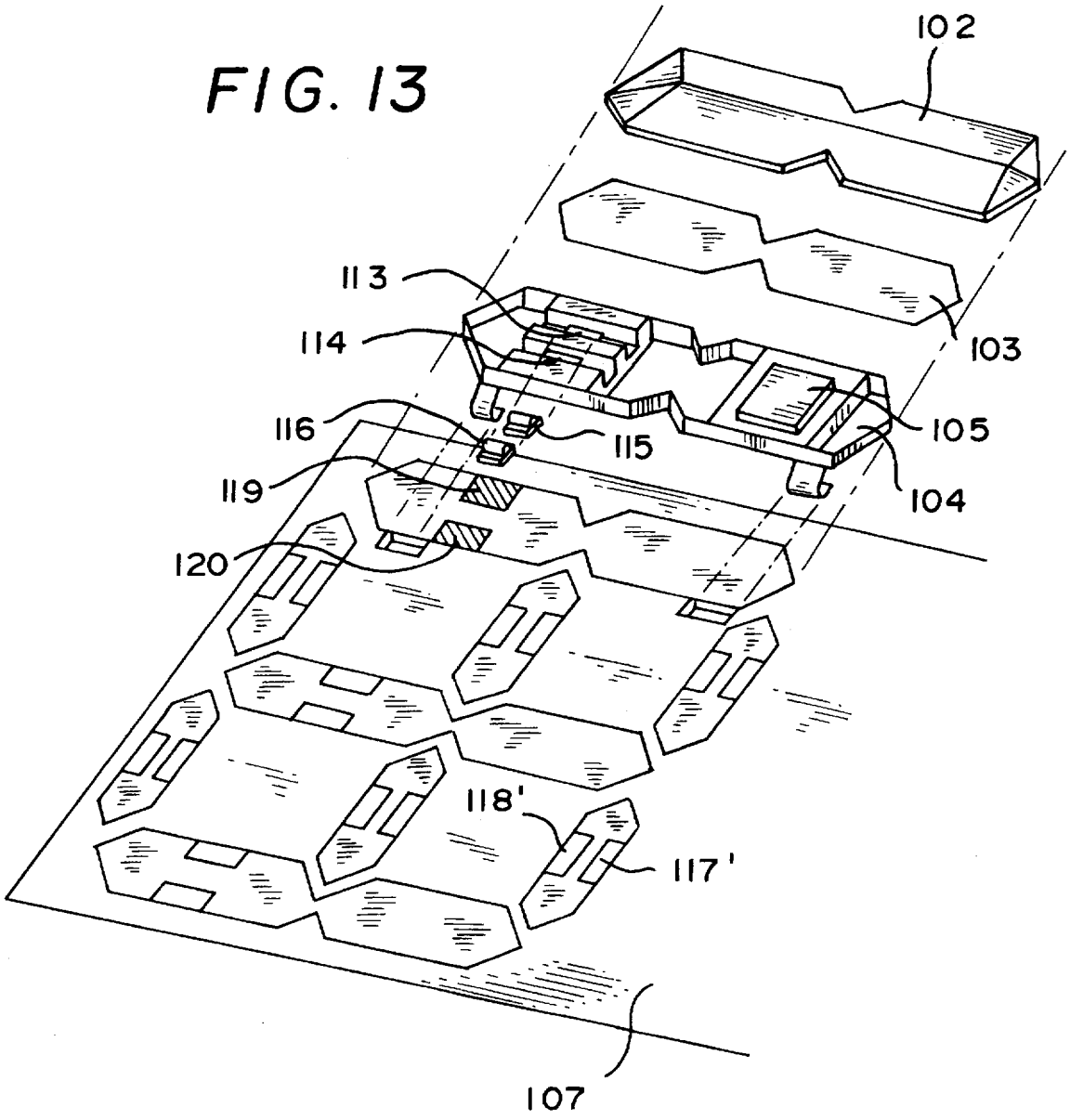
FIG. 13 is yet another perspective view of the a portion of the EL assembly of FIG. 8.
Figure 14:
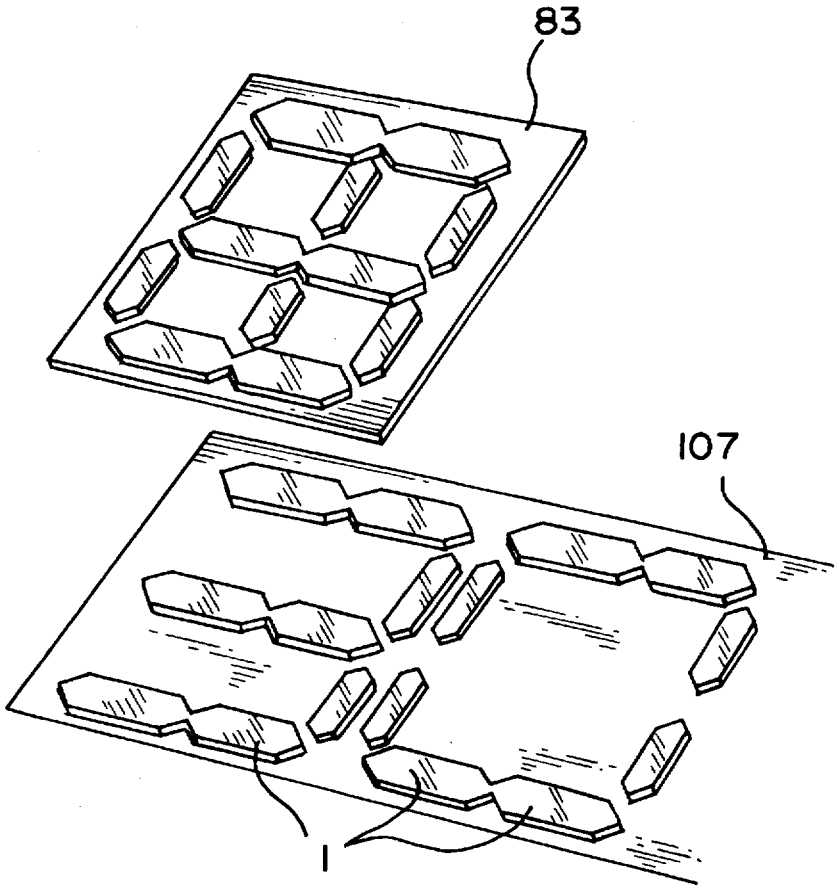
FIG. 14 is an additional perspective view of a portion of the EL assembly of FIG. 8.

As in the first preferred embodiment, the EL units are mounted to the circuit board via resilient legs having at distal ends thereof hooks or transverse extensions. The EL unit is mounted to the circuit board by inserting legs 6 and 6' through corresponding openings 17 and 18 in the circuit board such that legs 15 and 16 flex outwardly as the pass through the openings and then are hooked by extensions 150 and 160 as the extensions pass through the opening and engage an opposite side of the board. This causes contact 13 and 14 to be pressed against traces 19 and 20 to thereby establish electrical contact therewith. It will of course be appreciated by those skilled in the art that the specific form of the legs illustrated in FIGS. 10 and 13 is not to be taken as limiting, and that legs having the for shown in FIG. 3-2, or other appropriate shapes, may be substituted so long as the legs provide easy installation and removal of the individual light units. As in the first preferred embodiment, the cover may be attached to the housing by ultrasonic welding or the like to complete a durable yet inexpensive EL unit, and the arrangement of components on the circuit board as well as details the EL unit construction, including the contact and mounting arrangements may be varied by those skilled in the art without departing from the scope of the invention. FIG. 14 shows one possible arrangement of the individual light units of this embodiment of the invention.

Figure 15:
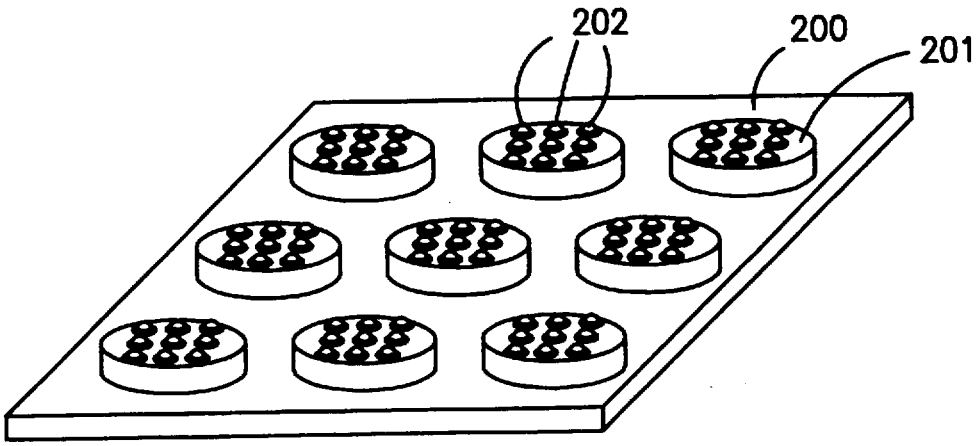
FIG. 15 is a perspective view of a master EL light board which has mounted thereon a plurality of EL sub-assemblies, each made up of a circuit board, sub-assembly housing, and a plurality of individual EL light units in each sub-assembly according to a third preferred embodiment of the invention.

Finally, as shown in FIGS. 15–24B, the lighting assemblies of the preferred embodiments may be modified to form sub-assemblies of a larger master assembly and thereby provide even greater versatility for certain applications, and in particular as a substitute for the conventional "so-called "L.O.D." arrangement of LEDs, the use of EL sub-assemblies providing a greater variety of color effects, an increased viewing angle, better picture resolution (fine details), lower cost and greater durability. For example, as shown in FIG. 15, nine discrete self-contained sub-subassemblies may be arranged on a master printed circuit board to form a larger, more colorful pattern than is possible with just the individual light units. If each subassembly includes 13 different color units, each having a total of 20 different possible colors, then each sub-assembly can have 20×13=260 color spots. A master EL light assembly could have as many as 200 such sub-assemblies, each with a 260 color pixel resolution.

As illustrated in greater detail in FIGS. 16 and 17, each sub-assembly includes a circular printed circuit board 201 having openings and contact terminals corresponding to those described in connection with the variation of the first preferred embodiment of the invention shown in FIG. 3-2, and a corresponding individual light unit 202 having conductive rubber terminals 203 (depicted as tubes instead of stepped members), mounting features 204 and 205, a housing 206, and an optical cover 207 for providing different optical effects, all as previously described in connection with the above embodiments of the invention. Those skilled in the art will appreciate that other mounting, contact, and individual EL unit constructions could be substituted for the illustrated construction.

Figure 18:
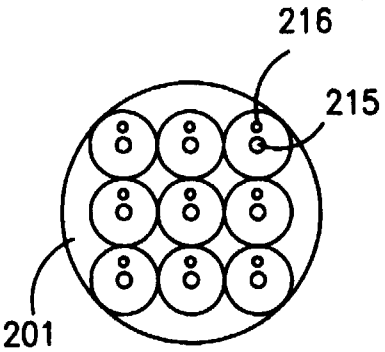
FIGS. 18, 18A, 19, 19A, 20, 21, 22, and 22A each is a top view of various arrangements of the contact terminals and mounting leg openings for the sub-assembly shown in FIGS. 16 and 17.
Figure 19:
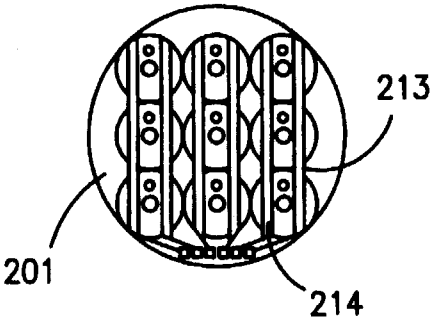

Unique to this embodiment of the invention is the inclusion of a cylindrical self-contained sub-assembly housing 208 which encloses the control circuit 209, a wiring harness 210, and an electrical pin set 211 and adapter 212 for electrically connecting the control circuit to buses on the circuit board. Also unique to this embodiment, although the concept could also be applied to the other embodiments, is the provision of three different sets of high voltage buses 213 and low voltage buses 214, allowing separate control of subsets of the individual EL units mounted on the circuit board, in this case in groups of three, with three colors in each group, as best shown in FIGS. 18 and 19, wherein the EL unit mounting openings are indicated by reference numerals 215 and 216 and the number of pins and corresponding terminals in the electrical pin set 211 is six.

Figure 18A:
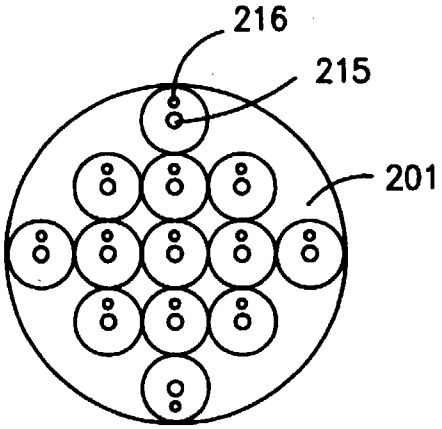
Figure 19A:
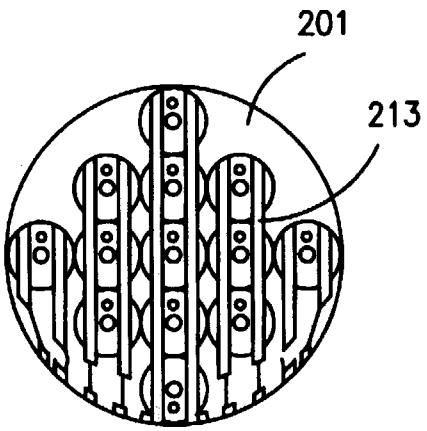
Figure 20:
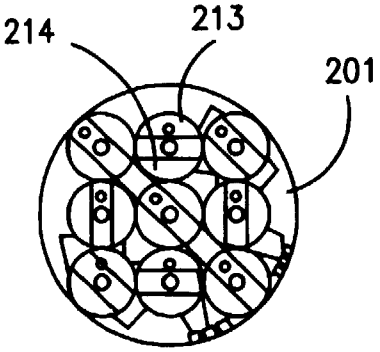
Figure 21:
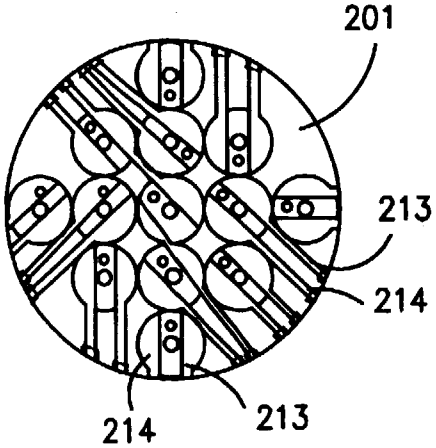
Figure 22A:
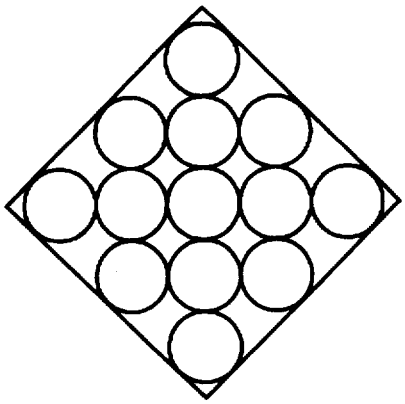
Figure 22:
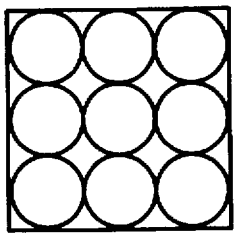

Alternatively, as shown in FIGS. 18A and 19A, the number of EL units provided for in the sub-assembly could be increased to thirteen units, arranged in five groups requiring five sets of buses and ten terminals, or the parallel bus arrangement shown in FIGS. 18, 19, 18A, and 19A could be modified to distribute the different color groups throughout the sub-assembly as shown in FIG. 20, in which the different groups are no longer parallel, or to increase the number of groups as shown in FIG. 21, in which the thirteen units are divided into thirteen single unit "groups" requiring 26 terminals. Furthermore, the sub-assemblies could be varied to have a rectangular shape, as shown in FIGS. 22 and 22A, and in fact could have any desired shape and arrangement of individual units as those skilled in the art will appreciate based on the above description.

Having thus described a number of different preferred embodiments of the invention in term which should enable those skilled in the art to make and use the invention, it is noted that numerous additional variations and modifications of the invention will undoubtedly occur to those skilled in the art upon review of the above description, and it is accordingly the intention of the inventor that the invention not be limited by the above description or drawings, but rather that it be interpreted solely in accordance with the appended claims.

We claim:

1. A light assembly, comprising:

a circuit board having a plurality of identical openings and a plurality of identical pairs of contact terminals respectively connected to one of two common inputs;

an individual electro-luminescent (EL) light unit in which is secured an EL panel and which includes light unit mounting means extending therefrom for insertion into any of said plurality of openings to thereby removably mount the individual electro-luminescent light unit on the circuit board;

a pair of electrical contacts; and means for positioning the electrical contacts in the individual EL light unit in such a way that electrical contact between the EL panel and one of said pairs of contact terminals is established by insertion of said light unit mounting means into any of said openings.

2. A light assembly as claimed in claim 1, wherein the means extending from the individual light unit comprises at least one leg having an extension which forms a hook and which is arranged to flex upon insertion into said any of said openings until the extension clears the opening, whereupon the extension is arranged to engage an opposite side of the circuit board from a side engaged by a housing of the individual electro-luminescent unit and thereby secure the individual electro-luminescent unit to the circuit board.

3. A light assembly as claimed in claim 2, wherein the means extending from the individual light unit includes a second leg having an extension.

4. A light assembly as claimed in claim 2, wherein said individual light unit includes a leg assembly positioned centrally relative to the individual light unit such that the leg assembly forms a rotation axis for said light unit, made up of said at least one leg having an extension, and further comprising a second leg arranged to enter an opening in the circuit board for the purpose of preventing rotation of individual light unit about said rotation axis after mounting the light unit on the circuit board.

5. A light assembly as claimed in claim 1, wherein the pair of contacts are arranged to engage said contact terminals upon mounting of the individual light unit on the circuit board and thereby establish an electrical connection between said contact terminals and said electro-luminescent panel in said individual light unit.

6. A light assembly as claimed in claim 1, wherein the individual light unit is cylindrical.

7. A light assembly as claimed in claim 1, wherein the individual light unit has a polyhedral shape.

8. A light assembly as claimed in claim 1, wherein said individual light unit includes a housing to which the electro-luminescent panel is attached and a transparent cover which as a result of its optical properties serves as a lens for light emitted by the optical panel through the transparent cover.

9. A light assembly as claimed in claim 1, further comprising a power source and means for converting the power input from the power source to an AC trigger current, means for controlling the AC current to control an on/off timing of the electro-luminescent panel, and means for supplying the output of a control circuit to buses on the circuit board.

10. A light assembly as claimed in claim 9, wherein said power source is a solar energy-based power source.

11. A light assembly as claimed in claim 1, wherein said electro-luminescent panel is made up of elements of different colors, and further comprising additional pairs of electrical contacts, one for each of said elements.

12. A light assembly, comprising:

a circuit board having a plurality of identical openings and a plurality of identical pairs of contact terminals respectively connected to one of two common inputs;

an individual electro-luminescent light unit in which is secured an electro-luminescent panel and which includes means extending therefrom for insertion into any of said plurality of openings to thereby removably mount the individual electro-luminescent light unit on the circuit board; and a pair of electrical contacts positioned in the individual electro-luminescent light unit for establishing electrical contact between the electro-luminescent panel and one of said pairs of contact terminals upon mounting of the individual light unit on the circuit board, wherein the pair of contacts are arranged to engage said contact terminals upon mounting of the individual light unit on the circuit board and thereby establish an electrical connection between said contact terminals and said electro-luminescent panel in said individual light unit, wherein said individual light unit includes a housing to which is secured the electro-luminescent panel, and wherein said pair of contacts are made of a resilient conductive material having a dimension which exceeds a distance between electrodes of the electro-luminescent panel and corresponding said contact terminals such that when the individual light unit is mounted on the circuit board, the contacts are compressed between the contact terminals and the electro-luminescent panel electrodes to ensure a positive electrical connection therebetween.

13. A light assembly as claimed in claim 12, wherein said contacts extend through slots in said housing and have a width which is greater than that of the slots such that said contacts are retained in said slots by compression of a portion of the contacts upon insertion of the contacts into the slots.

14. A light assembly as claimed in claim 13, wherein said cover is an optical element.

15. A light assembly as claimed in claim 13, wherein said EL panel is secured to said housing by double-sided tape.

16. A light assembly as claimed in claim 12, wherein said individual light unit further comprises a cover, with said EL panel being secured between the cover and a top surface of said housing such that said EL panel is visible through said cover.

17. A light assembly, comprising:

a circuit board having a plurality of identical openings and a plurality of identical pairs of contact terminals respectively connected to one of two common inputs;

an individual electro-luminescent light unit in which is secured an electro-luminescent panel and which includes means extending therefrom for insertion into any of said plurality of openings to thereby removably mount the individual electro-luminescent light unit on the circuit board; and a pair of electrical contacts positioned in the individual light unit for establishing electrical contact between the electro-luminescent panel and one of said pairs of contact terminals upon mounting of the individual light unit on the circuit board, further comprising additional individual light units, wherein said light assembly is one of a plurality of sub-assemblies of a master assembly, said sub-assemblies being arranged into groups, each group being connected by a common bus pair to a common pair of connector pins and by a wiring harness to a master circuit board on which are arranged said plurality of additional sub-assemblies.

18. A light assembly as claimed in claim 17, wherein said one of a plurality of sub-assemblies is provided with a housing on which the light assembly circuit board is mounted and which encloses said connector pins.

19. An individual EL light unit for removably mounting on a circuit board having a plurality of openings and a plurality of pairs of contact terminals, comprising:

a housing;

an electro-luminescent (EL) light panel;

light unit mounting means extending from the housing for insertion into any of said plurality of openings to thereby removably mount the individual electro-luminescent light unit on the circuit board;

a pair of electrical contacts; and means for positioning the electrical contacts in the housing in such a way that electrical contact between the EL panel and one of said pairs of contact terminals is established by insertion of said light unit mounting means into any of said openings.

20. An individual light unit as claimed in claim 19, wherein the means extending from the housing comprises a leg having an extension which form a hook and which is arranged to flex upon insertion into said any of said openings until the extension clears the opening, whereupon the extension is arranged to engage an opposite side of the circuit board from a side engaged by said housing and thereby secure the individual EL unit to the circuit board.

21. An individual light unit as claimed in claim 20, wherein the means extending from the housing includes a pair of said legs having an extension, and said openings are arranged in pairs to form a matrix or said pairs.

22. An individual light unit as claimed in claim 20, wherein said individual light unit includes a centrally positioned leg assembly made up of at least one of said legs having an extension, and further comprising a second leg arranged to enter an opening in the circuit board for the purpose of preventing rotation of the housing after mounting on the circuit board.

23. An individual light unit as claimed in claim 19, wherein said EL panel is secured to said housing by double-sided tape.

24. An individual light unit as claimed in claim 19, wherein the individual light unit is cylindrical.

25. An individual light unit as claimed in claim 19, wherein the individual light unit has a polyhedral shape.

26. An individual electro-luminescent light unit for removably mounting on a circuit board having a plurality of openings and a plurality of pairs of contact terminals, comprising:

a housing;

an electro-luminescent light panel;

means extending from the housing for insertion into any of said plurality of openings to thereby removably mount the individual electro-luminescent light unit on the circuit board; and a pair of electrical contacts positioned in the housing for establishing electrical contact between the electro-luminescent panel and one of said pairs of contact terminals upon mounting of the housing on the circuit board, wherein said electro-luminescent panel is secured to said housing, and wherein said pair of contacts are made of a resilient conductive material having a dimension which exceeds a distance between electrodes of the electro-luminescent panel and corresponding said contact terminals such that when the individual light unit is mounted on the circuit board, the contacts are compressed between the contact terminals and the electro-luminescent panel electrodes to ensure a positive electrical connection therebetween.

27. An individual light unit as claimed in claim 26, wherein said contacts extend through slots in said housing and have a width which is greater than that of the slots such that said contacts are retained in said slots by compression of a portion of the contacts upon insertion of the contacts into the slots.

28. An individual light unit as claimed in claim 26, wherein said individual light unit further comprises a cover, with said EL panel being secured between the cover and a top surface of said housing such that said EL panel is visible through said cover.

29. An individual light unit as claimed in claim 28, wherein said cover is an optical element.

* * * * *